US005935914A

United States Patent [19]

Theyssen et al.

[11] Patent Number: 5,935,914

[45] Date of Patent: Aug. 10, 1999

[54] LUBRICANTS FOR CONVEYOR BELT INSTALLATION IN THE FOOD INDUSTRY

[75] Inventors: Holger Theyssen; Karlheinz Laping; Stefan Wiemer, all of Mannheim, Germany

[73] Assignee: Diversey Lever, Inc., Plymouth, Mich.

[21] Appl. No.: 08/950,774

[22] Filed: Oct. 15, 1997

[30] Foreign Application Priority Data

Oct. 16, 1996 [DE] Germany ..... 196 42 598

[51] Int. Cl.[6] ..... C10M 173/02

[52] U.S. Cl. ..... 508/517; 508/527; 508/532

[58] Field of Search ..... 508/517, 527, 508/532

[56] References Cited

U.S. PATENT DOCUMENTS

| | | | |
|---|---|---|---|
| 2,653,972 | 9/1953 | Ash et al. | 508/517 |
| 4,274,973 | 6/1981 | Stanton et al. | 508/527 |
| 4,839,067 | 6/1989 | Jansen . | |
| 4,859,351 | 8/1989 | Awad | 508/517 |
| 5,062,978 | 11/1991 | Weber et al. | 508/503 |
| 5,062,979 | 11/1991 | Scharf et al. . | |
| 5,073,280 | 12/1991 | Rossie et al. | 508/527 |
| 5,182,035 | 1/1993 | Schmidt et al. | 508/527 |
| 5,244,589 | 9/1993 | Liu et al. | 508/527 |
| 5,441,654 | 8/1995 | Rossio | 508/527 |
| 5,474,692 | 12/1995 | Laufenberg et al. . | |

FOREIGN PATENT DOCUMENTS

| | | |
|---|---|---|
| 0 044 458 | 1/1982 | European Pat. Off. . |
| 0 372 628 | 11/1989 | European Pat. Off. . |
| 0 384 282 | 2/1990 | European Pat. Off. . |
| 42 44 536 | 12/1992 | Germany . |
| 95/19412 | 7/1995 | WIPO . |

*Primary Examiner*—Margaret Medley
*Attorney, Agent, or Firm*—Milton L. Honig

[57] ABSTRACT

A lubricant concentrate is disclosed, of which the aqueous use solution is suited for lubricating, cleaning and disinfecting of feed and conveyance installations in the food industry, particularly immersion or automatic belt lubricating equipment, the concentrate including (i) one or more amines;

(ii) one or more ether carboxylic acid compounds;

(iii) one or more polyethyleneglycol (PEG's); and (iv) up to 99 wt. % (wt/wt) of the usual aids and additives.

8 Claims, No Drawings

LUBRICANTS FOR CONVEYOR BELT INSTALLATION IN THE FOOD INDUSTRY

FIELD OF THE INVENTION

The present invention relates to a lubricant concentrate, of which the aqueous use solution is suitable for lubricating, cleaning and disinfecting of conveyor belt installations in the food industry, particularly by means of immersion or automatic belt lubricating systems.

The invention further relates to a process for the production of the lubricant concentrate or the aqueous use solution of the lubricant concentrate as well as the use of the lubricant concentrate and the aqueous use solution for lubricating, cleaning and disinfecting of conveyer belt installations, in particular by means of immersion lubricating or automatic belt lubricating installations, particularly in the food industry. The use thereby particularly relates to the filling up with foods, especially with beverages, of glass and plastic bottles, boxes, glasses, vessels, beverage containers, paper and cardboard holders and the like.

BACKGROUND OF THE INVENTION

The object of the invention is a process for the conveyance of beverage packings made of metal, glass, paper, cardboard and/or plastic, particularly in this case polyethylene terephthalate or polycarbonate, whereby the lubricant concentrate according to the invention, respectively its aqueous use solution, is applied.

Presently beverages are being sold in several different containers. Thus, beverages are offered in glass bottles, plastic bottles, plastic containers, boxes, wax cartons, etc. In the filling works these containers have to be transported during filling to several stations. Generally this occurs by means of feed or conveyance installations, which usually consist of stainless steel, insofar as these containers concern glass containers or consist of plastic materials like polypropylene or certain polyacetates, insofar as these containers concern other than glass bottles or glass containers. Following hereafter, such installations are referred to as feed and conveyance installations.

During filling and transport of the mentioned containers sometimes a turning over or a blocking of the containers may occur, while the conveyor belts are running further without hindrance. Especially in this case a sufficient lubrication of the conveyor belts is required in order that the belt can move forward without hindrance even when the containers on the belt cannot move forward during some time.

For this purpose it is required, as already mentioned before, to lubricate and to clean the parts of the feed and conveyance installations, which come into contact with the beverage containers, sufficiently. If the conveyance installations are not lubricated sufficiently this can, on the one hand, lead to the falling down of the containers, or on the other hand, have the result that they do not stop, although the respective filling up, cleaning or labelling station has already been reached. Both kinds of malfunctions can lead to longer standing times of the conveyance installations and to considerable loss of capacity.

It should also particularly be watched in the food industry that, besides the lubricating and cleaning action, the chain lubricating means have a sufficiently disinfecting, especially biostatic, action. In principle it should be decided that germ promoting use solutions of lubricant con- centrates should not be used.

Presently the applied chain lubricants can in principle be divided into three main groups:

1. Lubricants on basis of soap,
2. Lubricants on basis of fatty amines and
3. Lubricants on basis of phosphate esters.

Although lubricants on basis of soap and namely in the immersion lubrication can be applied relatively trouble-free, the use of lubricants on basis of soap with the presently common centralized lubrication systems causes a number of disadvantages. For example only the disadvantage has to be mentioned that such chain lubricants based on soap are more sensitive towards water hardness, so that they cannot be applied without the use of a complexing agent like e.g. ethylene diamine tetra-acetic acid (EDTA) which can partly mask the hardness of the water. However it is just EDTA, as well as other possible complexing agents, which should be avoided on ground of their ecological disadvantages (relatively difficult degradability in biological purification systems). Similar disadvantages are also shown by use solutions of chain lubricants which are composed on basis of phosphate ester. Therefore presently lubricant concentrates on basis of fatty amines are being applied more and more.

The following publications are mentioned with respect to the specific state of the art as regards lubricant concentrates on basis of fatty amines:

D1=DE 36 31 953 A1;
D2=EP 0 372628B1;
D3=EP 0 8384282B1;
D4=WO 94/03562; and
D5=WO 95/19412.

A process is disclosed in D1 for the maintenance of chain shaped bottle conveyors in beverage filling works, especially in breweries, in which the chain shaped bottle conveyors are lubricated with conveyor lubricants on basis of neutralized primary fatty amines and are cleaned with cationic cleaning agents or organic acids. In the process known from D1, conveyor lubricants on basis of neutralized primary fatty amines are used, which preferably show 12 to 18 C-atoms and have an unsaturated content of more than 10%.

The application of an aqueous lubricant solution is known from D2, which solution consists of (A) 0.001 to 1 wt. % on basis of the weight of the aqueous lubricant solution of at least one compound with the formula

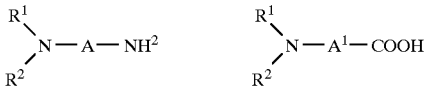

wherein $R^1$ is a saturated or an unsaturated, branched or linear alkyl group with 8 to 22 carbon atoms, $R^2$ is hydrogen, an alkyl group or hydroxyl-alkyl group with 1 to 4 carbon atoms or —A—$NH^2$, A is a linear or branched alkyl group with 1 to 8 carbon atoms and $A^1$ is a linear or branched alkylene group with 2 to 4 carbon atoms, which has a pH-value of 5 to 8, for the lubrication of conveyor belts.

Both the lubricants known from D1 and D2 generally have a poor water hardness tolerance. They tend to react with compounds in the water, particularly with sulphates, bicarbonates, phosphates and carbonates, especially in alkaline water, as well as with other compounds which are present in the water, whereby the reaction products could lead to the development of waste, which block the dosing installation. This leads to the feared "nozzle-blocking" of sieves and spray nozzles of the dosing installation.

Moreover, the lubricants on basis of fatty amines also have an unsatisfactory foam behaviour. Thus, the lubricants according to D2 tend to have an intensive foam formation, which requires afterwards a cleaning of the goods conveyed on the conveyor belt. Other lubricants, like e.g. the composition known from D1, rather tend to a too low formation of foam, which leads to a too fast disappearing of the applied lubricating layer.

It is known from D3 that the application of secondary and/or tertiary amines and/or salts of such amines, whereby the applied compounds essentially are analogous to the amines known from D2, in quantities of 1 to 100 wt. %, if so desired together with the usual diluents, aids or additives, serve as chain lubricants for automatic chain and conveyor belt lubricating installations in the food industry, for the conveyance of plastic objects made of polyethylene terephthalate or polycarbonate. The lubricant compositions known from D3 should not cause stress rupture corrosion thereby, in contrast to standard soap products, when applied with plastic objects, whereby the compositions disclosed according to D3 are particularly suitable for PET and PC-objects. Nevertheless, the lubricant systems known from D3 further exhibit the same disadvantages, which are mentioned above with respect to the lubricants known from D2. The main disadvantage of the lubricants known from D3 is on the one hand the strong water dependence and on the other hand the regularly required system cleaning, which likewise is determined by the kind of compounds in the water. The waste products which are occurring thereby have to be removed. When using lubricants on basis of fatty amines, organic or inorganic acids are applied thereby as cleaner.

In D4 only lubricant concentrates are disclosed on basis of fatty amines and possibly the usual diluents or aids, resp. additives, which are characterized that the composition contains at least one polyamine derivative of a fatty amine and/or a salt of such an amine, whereby the contribution of the polyamine derivative of the fatty amine to the total composition is 1 to 100 wt. %. Although the lubricants known from D4 show a better 'clear water solubility', as well as a more favourable foam behaviour, in comparison with the lubricants known from D2 or D3, also the lubricants known from D4 are possessing certain disadvantages. These include among others a lacking biodegradability. Up to now it has not been possible to biodegrade chain lubricants based on amines in anaerobic purification installations.

Moreover, the compositions described in D4 are detrimental in anaerobic purification installations because of the relatively high use concentration of polyamines.

Nevertheless, its use concentration cannot be lowered just like that, without reducing on the one hand the microbiocide effectiveness to an undesired level, or on the other hand to cancel out the necessary lubricating action. It is possible that an undesired gap of the lubricating film will occur at lower concentrations.

Finally, D5 enriches the state of the art with lubricants containing imidazoline, salts of it or amide, which can occur as intermediate products during the synthesis of imidazoline or as reduction products during the hydrolysis of imidazoline. Although the lubricant concentrates on basis of imidazoline known from D5, respectively its aqueous use solutions, as regards a biocide effect and also as regards a lubricating effect, can completely meet the requirements for appropriate means in the food industry with respect to lubricating, cleaning and disinfecting of feed and conveyance installations, the imidazolines also show certain disadvantages. Thus, under the ecological points of view which have to be taken into consideration nowadays, a biological tolerance and degradability of the lubricant concentrates applied for example in the beverage filling works, which end up in the biological purification, is absolutely necessary in other words for each purification system both an aerobic and an anaerobic degradability in the biological purification installation should be possible. Although this requirement is better met by the chain lubricants based on the imidazoline known from D5 as is the case with some of the chain lubricants based on amine known from D2, D3 or D4, the degradability of the chain lubricants over the whole line need improvement.

Moreover, the chain lubricants according to D3, D4 and also the lubricants according to D5 show a so-called lubricating gap, i.e. the gliding properties in soft water are relatively limited. This means that the friction values in soft water are relatively high. Thus, the known chain lubricants also need to be improved with respect to the lubrication gap.

Although other chain lubricants are known in the state of the art which do not show some of the above indicated disadvantages, however none of the presently known chain lubricants is in the position to fulfil all requirements like water hardness tolerance, aerobic and anaerobic degradability, as well as avoidance of the lubrication gap, to the same extend.

Thus, lubricant compositions are described in EP-A-0 044 458 which practically are free of fatty acid soaps and which contain further a carboxylated, non-ionic tenside and an acylsarcosinate. The pH-value of these products is between 7 and 11 and preferably is within the neutral up to the alkaline range.

DE-A-38 31 448 concerns aqueous soap-free lubricant compositions which are 'clear water soluble', a process for the preparation of these and the use of these lubricant compositions, in particular as lubricants for steel plate conveyors, for the conveyance of glass bottles or polyethylene terephthalate bottles. The, essentially neutral, aqueous lubricant preparations (pH- values within the range of 6 to 8) contain alkylbenzolsulphonate, alkoxylated alkanolphosphate and alkane carboxylic acids, possibly next to the usual intermediate solutions, solvents, defoaming agents and disinfectants.

Nevertheless also the mentioned amine-free products show certain disadvantages, for example they are unfavourable considered from a microbiological point of view, because they create excellent growth conditions for a microorganism, they only have a limited cleaning power and finally they also show a difficult controllable foam behaviour.

Thus, in view of the above presented and discussed state of the art, it was also an object of the invention to place at the disposal a lubricant concentrate which avoids as far as possible the disadvantages of known lubricant preparations according to the state of the art with respect to the water hardness tolerance, the toxicity of the compounds in the lubricant as well as the friction values in soft water. At the same time the lubricant concentrate should display a high substantivity, i.e. an improvement of the moistening power, a lower friction value generally, a balanced foam behaviour, a good and 'clear water solubility', a good cleaning effect and an excellent biocide effect. Herein the concept 'clear water solubility' in water means the insusceptibility of the lubricant components against anions in natural waters, like sulphate, bicarbonate and the like. For example, if the 'clear water solubility' of a lubricant composition is not very marked, the composition could react with the compounds in the water during a longer standstill of the installation, for example during the course of a weekend. The resulting waste and turbidity in the use solutions of the lubricants lead in the short or medium term to clogging up of the filters and nozzles of the conveyor lubricating systems.

SUMMARY OF THE INVENTION

The lubricant concentrate according to the invention comprises the following components:

(i) one or more amines;

(ii) one or more ether carboxylic acid compounds with the general formula I $$R^1-(O(CH_2)_m)_nOCH_2COO^-M^+ \quad (I),$$

wherein $R^1$ is a saturated, linear or branched $C_1$–$C_{22}$ alkyl group, a mono or polyunsaturated, linear or branched, alkenyl or alkinyl group with 2 to 22 carbon atoms or possibly a mono or poly $C_1$–$C_{22}$ alkyl or $C_2$ –$C_{22}$ alkenyl or alkinyl substituted aryl group, m is 2 or 3, n is a positive number in the range of 1 to 30, and M is hydrogen or an alkali metal;

(iii) is one or more polyethyleneglycol (PEG) with the general formula II $$H-(OC_2H_4)_n-OH \quad (II),$$

wherein n is a positive number between 5 and ≦1,000,000; whereby the portion of the compounds (i)+(ii)+(iii) in relation to the concentrate is 1 to 100 wt. %, and said concentrate optionally contains (iv) up to 99 wt. % (wt/wt) of the usual aids and additives.

As a consequence, it is possible to place at the disposal a lubricant concentrate, which could not have been foreseen without anything further, which meets all requirements which a professional could pose with respect to a lubricant concentrate to be applied in the food industry for the lubrication, cleaning and disinfecting of feed and conveyance installations. Particularly the combination of amine, ether carboxylic acid and polyethyleneglycol are co-operating very advantageously, so that, because of the common application of the components contained in the lubricant concentrate according to the invention, the high amount of the relatively toxic amine compounds can be lowered, so that the lubricant concentrate is biologically compatible as well as degradable and even so at the same time can exert an adequate biocide action. It should be emphasized thereby that the lubricant concentrates according to the invention, respectively the use solutions are degradable, aerobically as well as anaerobically.

Moreover, the lubricant concentrates according to the invention show relatively low friction values in soft water, so that the gliding properties in soft water essentially are not reduced. Therefore a lubrication gap, which for example sometimes is present with amines, is lacking completely. Finally, the lubricant concentrates according to the invention possess an excellent hard water tolerance, i.e. also in connection with hard water no waste forming is occurring in the dosing installation; the components contained in the lubricant concentrate according to the invention are all compatible with plastics, so that the concentrates according to the invention are extremely suitable for the lubrication of feed and conveyance installations which serve for the transport of PET or PC-objects; the lubricant concentrates according to the invention also meet the requirements from a microbiological point of view as chain lubricants, in total show very low friction values and can also convince with respect to the substantivity. This means that very surprisingly the contact of the lubricant with the feed and conveyor belts of the feed and conveyance installations is better compared with the traditional lubricants, so that less substance is required to achieve the same lubricating effect. This contributes towards a considerable reduction of the water usage in a filling installation, so that not only less of the lubricant concentrate but also less water is used.

Finally the compositions according to the invention show an outstanding foam behaviour. Surprisingly it was found that the use solutions stay absolutely free of foam, also at a higher mechanical action, even over long periods of time.

Lubricant concentrates according to the invention show three essential and one optional components, whereby it should be understood, that the essential components (i) to (iii) as well as the optional components (iv) could each consist of multiple components. The components (i) to (iv) are described individually following hereafter.

DETAILED DESCRIPTION OF THE INVENTION

The components (i)

The lubricant concentrate according to the invention contains as component (i) essentially one or more amines. The term "amine", as used in the context of the invention, includes thereby in a broader context monoamine, polyamine, cyclic amidine as well as its hydrolysis products or non-cyclic synthesis pre-steps, oxalkylated amine and salts of the previously mentioned compounds.

The monoamines which can be applied according to the invention include, among others, primary, secondary and tertiary amines according to the general formulas III—V,

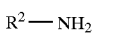

(III)

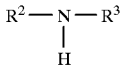

(IV)

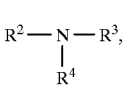

(V)

wherein $R^2$, $R^3$ and $R^4$ independently from each other are the same or different and indicate $C_1$–$C_{30}$-alkyl, $C_5$–$C_{30}$-aryl, $C_2$–$C_{30}$-alkenyl or alkinyl, $C_3$–$C_{30}$-cycloalkyl, $C_6$–$C_{30}$-alkaryl or heteroaryl with 5 to 7 ring atoms, whereby the mentioned group could indicate one or more amine, imine, hydroxyl, halogen and/or carboxyl rests, as well as salts of the compounds with the formula III–V. Two of the rests $R^2$ to $R^4$ could also be closed to form a ring, so that cyclic amines, like e.g. pyridine, chinoline, isochinoline, piperazine, morpholine, etc., as well as its C-alkyl derivatives.

Preferred monoamine compounds are those according to the general formula IV and V, as well as salts of these compounds, which correspond to the general formulas VI and VII,

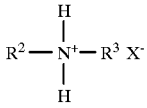

(VI)

-continued (VII)

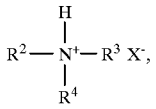

wherein $R^2$, $R^3$ and $R^4$ independently from each other are the same or different and indicate:

a substituted or unsubstituted, linear or branched, saturated or mono or polyunsaturated alkyl group with 6 to 22 C-atoms, which as substituents can display at least one amine, imine, hydroxyl, halogen and/or carboxyl group, a substituted or unsubstituted phenyl group, which as substituents can display at least one amine, imine, hydroxyl, halogen, carboxyl and/or a linear or branched, saturated or mono or polyunsaturated alkyl group with 6 to 22 C-atoms, and as the anion $X^-$, all the customary rests, which are familiar to the professional, which originate from inorganic acids or organic acids and which do not influence the lubricant concentrate according to the invention in a detrimental manner, for example do not result in undesired turbidity or standstills, can be applied.

In the sense of the present invention such acids are preferred of which the anion $X^-$ is chosen from the group: amidosulphonate, nitrate, halide, hydrogensulphate, sulphate, hydrogencarbonate, carbonate, phosphate or $R^5$—$COO^-$, whereby the group $R^5$ indicates hydrogen, a substituted or unsubstituted, linear or branched alkyl group with 1 to 20 C-atoms, whereby the substituents are chosen from one or more hydroxyl, amine, imine and/or carboxyl rests. Especially mentioned as examples for the organic anions $X^-$ i of the type $R^5$—$COO^-$ are: formate, acetate, glycolate, oleate, lactate, gluconate, citrate and glutamate.

Applicable with special advantages are in particular such monoamines or salts of it which correspond to the general formulas IV, V, VI and VII, wherein $R^2$ is a saturated or unsaturated, branched or linear alkyl group with 8 to 22 carbon atoms, $R^3$ indicates $A^1$—COOH, wherein $A^1$ indicates a linear or branched alkenyl group with 2 to 4 carbon atoms and $R^4$ indicates an alkyl group or hydroxyl-alkyl group with 1 to 4 carbon atoms.

Polyamines which also could be applied according to the invention as components (i) are those corresponding to the general formula VIII, (VIII)

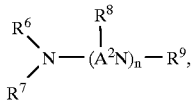

wherein $R^6$, $R^7$, $R^8$ and $R^9$ independently from each other are the same or different and indicate:

hydrogen a substituted or unsubstituted, linear or branched alkyl rest with 1 to 22 C-atoms or a mono or polyunsaturated alkenyl group with 2 to 22 C-atoms, which could display as substituents one or more hydroxyl, amine, imine, halogen and/or carboxyl rests, a substituted or unsubstituted phenyl group, which could display as substituents one or more amine, imine, hydroxyl, halogen, carboxyl and/or possibly again substituted, linear or branched, saturated or mono or polyunsaturated alkyl group with 1 to 22 C-atoms, $A^2$ indicates a linear or branched alkylene group with 1 to 8 carbon atoms, and n is a positive integer number in the range of 1 to 30.

Particularly preferred are polyamines with the general formula VIII, wherein $R^7$, $R^8$ and $R^9$=hydrogen $A^2$=—$(CH_2)_3$—, and n=1.

Also the salts of those compounds which belong to the following general formula can be applied advantageously, (IX)

$$R^6—NH—(CH_2)_3N^+H_3\ X^-$$

(X)

$$R^6—{}^+NH_2—(CH_2)_3N^+H_3\ 2X^-,$$

wherein $R^6$ has the meaning as mentioned for the formula VII and $X^-$ the meaning as mentioned for the formulas VI and VII.

Efficient polyamines can also be obtained according to the general formula VIII, wherein $R^6$ is a saturated or unsaturated, branched or linear alkyl group with 8 to 22 carbon atoms, $R^7$ is hydrogen, an alkyl group of hydroxyl-alkyl group with 1 to 4 carbon atoms or $A^2$—$NH_2$, n=1 and $R^8$ and $R^9$ indicate hydrogen.

Some individual examples of polymers which could be applied according to the invention are among others ethylene diamine, diethylene triamine, triethylene tetra-amine, propylene diamine, dipropylene triamine, tripropylene tetra-amine, butylene diamine, aminoethyl propylene diamine, aminoethyl butylene diamine, tetramethylene diamine, hexamethylene diamine, N-cocos fatty-alkyl-1,3-diaminopropane, N-tallow fatty-alkyl-1,3-diaminopropane, N-oleyl-1,3-diaminopropane, N-lauryl-1,3-diaminopropane, each time in the form of the free amine or in the form of the salt like formate, acetate, oleate, glycolate, lactate, gluconate, citrate, glutamate, benzoate or salicylate.

Next to it also polyamine derivatives of a fatty amine according to the general formula XI can be applied as component (i) or as a constituent of the component (i) of the lubricant concentrate according to the invention, $$R^2—A^3—(CH_2)k—NH—[(CH_2)l—NH]y—(CH_2)_m—NH_2.(H^{+X-})_n \quad (XI),$$

whereby $R^2$ and $X^-$ have the meaning as indicated for the formulas VI and VII, $A^3$ either indicates —NH— or —O—, k, l, m independently from each other are the same or a different number in the range of 1 to 6, y indicates 0, 1, 2 or 3 in case $A^3$=—NH— and 1, 2, 3 or 4 in case $A^3$=—O—, and n is an integer in the range of 0 to 6.

In the above mentioned general formula (XI) the following group, groups can be applied as substituents $R^2$: n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl, n-nonadecyl, n-eicosyl, n-uneicosyl and n-docosyl as well as the branched-chain isomers of the mentioned alkyl rests. Instead of the saturated alkyl group $R^2$ can also indicate the corresponding—mono or poly—unsaturated alkyl group, which can also be linear or branched. The above indicated rests can also be substituted, whereby as substituents one or more amine, imine, hydroxyl, halogen or carboxyl group can be used. Moreover, the group $R^2$ also can indicate a phenyl rest, which can also be substituted with one or more amine, imine, hydroxyl, halogen or carboxyl group. Also alkylphenyl rests can be used for $R^2$ whereby the alkyl rest contains 6 to 22 C-atoms and which can also be linear or branched, saturated or mono or polyunsaturated. In all cases chlorine and bromine are preferred as halogen substituents.

According to the present invention also lubricant concentrates are preferred which contain as component (i) or as a constituent of component (i) at least a polyamine according to the general formula XI, whereby $A^3$=—NH—, k, l and m are independently from each other 3 or 4, y is 0 or 1 and the other variables have the meanings as are indicated before for the formula (XI).

Especially preferred thereby are all the amines wherein k, l and m is 3.

Polyamines which correspond to the previously indicated general formula XI can be prepared according to processes as are known from literature and further are also offered to some extend as commercial products by the company Berol Nobel, Stockholm, Sweden, under the denomination Amine 640, Amine 660, Amine 740, Amine 760 and Amine 780.

According to another preferred implementation of the present invention the lubricant concentrates in the components (i) contain one or more polyamine derivatives of fatty amines of the previously mentioned general formula (XI), whereby $R^2$ indicates a linear or branched, saturated or mono or polyunsaturated alkyl group with 12 to 18 C-atoms, $A^3$ indicates —NH— and $X^-$ indicates the group $R^5$—$COO^-$, whereby $R^5$ indicates hydrogen, $CH_3$—, HO—$CH_2$— or $CH_3$—CH(OH)—.

Also applicable as components (i) according to the invention with good results is cyclic amidine, for example imidazoline or tetrahydropyrimidine, etc., according to the general formula XII, (XII)

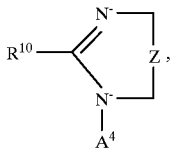

wherein

Z is an alkyl group with 1 to 6 C-atoms, $A^4$ is hydrogen or—$(A^5NH)_n$—H, $A^5$ is an alkylene group with 1 to 18 C-atoms, which possibly can be mono or polyunsaturated, and $R^{10}$ is an alkyl, aryl, alkaryl, cycloalkyl, alkarylalkyl or hetero-ring with—where possible and useful—respectively between 1 and 30 C-atoms.

Particularly advantageous mixtures are obtained according to the invention when the lubricant concentrate, or the component (i), contains at least a compound corresponding to the general formula XIII, (XIII)

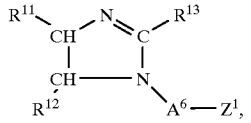

wherein, $R^{11}$, $R^{12}$, $R^{13}$ are the same or different hydrogen or $A^7$—$Z^2$, $A^6$ is a saturated or unsaturated, linear or branched alkylene group with 1 to 20 carbon atoms, $A^7$ is a saturated or unsaturated, linear or branched alkylene group with 7 to 20 carbon atoms, $Z^3$ is hydrogen, $NH_2$, OH or $COOM^1$, $M^1$ is hydrogen or an alkali metal, $Z^1$ is hydrogen, $NH_2$, OH, $COOM^2$ or —NH—CO—$R^{14}$, $M^2$ is the same or different from $M^1$ hydrogen or an alkali metal, and $R^{14}$ is a saturated or unsaturated, linear or branched alkyl group, respectively alkenyl group, with 6 to 20 carbon atoms.

With regard to the compounds according to the general formula XIII preferably at least one of the group $R^{11}$, $R^{12}$, $R^{13}$, $A^6$ and/or $R^{14}$ contains a saturated or unsaturated alkylene group with at least 12 C-atoms or a branched alkylene group with at least 12 carbon atoms.

Further, within the group of compounds according to the general formula XIII, those compounds where $A^7$ contains 12 to 18 carbon atoms are particularly useful, it is particularly preferred if $A^7$ corresponds to a $C_{17}$ rest group. A6 preferably has 1 to 6 carbon atoms, very favourable is a —$CH_2$—$CH_2$—group. A very advantageous variant of $Z^1$ is $NH_2$. Even more favourable properties have compounds according to the general formula XIII, or as constituent of the component (i), wherein $Z^1$ is $NH_2$, $R^{11}$ and $R^{12}$ is hydrogen, $R^{13}$ is $A^7Z^2$, $A^7C_{17}$ and $Z^2$ is hydrogen.

The cyclic amidines which could be applied particularly advantageously as component (i) also include salts of compounds with the general formula XIII, which correspond to the general formula XIV:

(XIV)

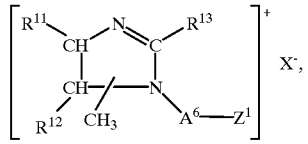

wherein the rests $R^{11}$, $R^{12}$, $R^{13}$, $A^6$ and $Z^1$ can take the 20 meaning as shown by formula XIII, the $CH_3$—ring substituent is bound in the 1 or 3-position of the imidazoline ring and $X^-$ is a suitable anion, as for example is indicated in connection with the explanation of $X^-$ in formula XI. It is particularly preferred if $X^-$ is $CH_3$—O—$So_3$—.

In addition to the cyclic compounds of the formulas XIII and XIV also linear amides with the general formula XV and XVI are suitable as component (i) or as constituent of the component, (XV)

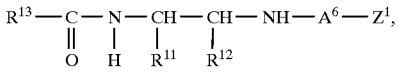

(XVI)

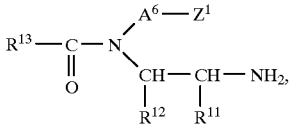

wherein the rests $R^{11}$, $R^{12}$, $R^{13}$, $A^6$ and $Z^1$ have the meaning as is indicated for the formulas XIII or XIV.

The compounds according to the formulas XV and XVI can also become available as by-products during the synthesis of the compounds XIII or XIV, they can also develop during the storage of these compounds, for example by hydrolysis, or also formed by means of direct synthesis without a detour via a cyclic intermediate product. Oxalkylated amines, e.g. oxalkylated derivatives of the amine mentioned herein are also suitable, within the scope of the invention, as constituent of the component (i). The oxalkylated derivatives thereby show the group $—(OA^8)_n—$, which can be derived from any suitable a,β-alkyleneoxide with the general formula XVII, (XVII)

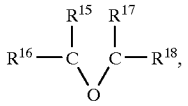

wherein $R^{15}$, $R^{16}$, $R^{17}$ and $R^{18}$ independently from each other are the same or different, hydrogen or a possibly substituted rest, like e.g. alkyl, cycloalkyl, aryl, etc.

Examples include among others ethyleneoxide, propyleneoxide, butyleneoxide, amyleneoxide, octyleneoxide, styroloxide, methylstyroloxide, cyclohexaneoxide (wherein $R^{15}$ and $R^{17}$ are forming a ring together), etc.; instead of alkyleneoxide also alkylenecarbonate, e.g. ethylenecarbonate, propylenecarbonate, etc., can be applied.

$—(OA^8)_n—$ means homo units like $—(OEt)_n—$, $—(OPr)_n—$, $—(OBu)_n—$, $—(O\ octyl)_n—$, etc.;

block units like $—(OEt)_a(OPr)_b—$, $—(OEt)_a(OBu)_b—$, $—(OPr)_a(OEt)_b(OPr)_c$, $—(OEt)_a(OPr)_b(OBu)_c$, etc., wherein a+b+c=n;

groups containing hetero units, which contain a coincidental statistical sequence of more than one oxide $(OEt\text{-}OPr)_n$, $(OPr\text{-}OBu)_n$, $(OEt\text{-}OBu)_n$, whereby the proportion of one oxide to the other is e.g. 1–99 to 99–1;

hetero—homo units like e.g.

$(EtO)_a(EtO—PrO)_b$, $(EtO)_a(PrO)_b(EtO—PrO)_c$, $(EtO—PrO)_a(BuO)b$, etc.

Especially preferred are compounds according to the general formulas XVIII and XIX, (XVIII)

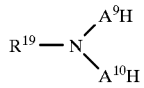

(XIX)

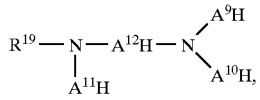

wherein $R^{19}$ is a linear or branched, saturated or unsaturated, alkylene rest with 8 to 22 carbon atoms, $A^{12}$ is a linear or branched alkylene group with 8 to 22 carbon atoms, $A^9$, $A^{10}$, $A^{11}$ are the same or different ethoxy or propoxy groups, whereby the total of the groups $A^9$, $A^{10}$, $A^{11}$ is between 2 and 200.

Useful compounds among others are:

Cocos-bis(2-hydroxylethyl)amine, polyoxyethylene (5) cocos-amine, polyoxyethylene (15) cocos-amine, tallow-bis(2-hydroxylethylamine, polyoxyethylene(5) tallow-amine, tallow/oleyl-bis(2-hydroxylethylamine, oleyl-bis(2-hydroxylethyl)amine, polyoxyethylene (5) oleylamine, polyethylene (15) oleylamine, tallow-bis(2-hydroxylethyl) amine (hydrated), polyoxyethylene (5) tallow-amine (hydrated), polyoxyethylene (15) tallow-amine (hydrated), polyoxyethylene (50) tallow-amine, N,N'N'-tris(2-hydroxylethyl)N-tallow-1,3-diaminopropane, N,N',N'-polyoxyethylene (10)-N-tallow-1,3-diamino-propane, N,N',N'-polyoxyethylene (15)-N-tallow-1,3-diaminopropane and poly oxyethylene (15)-tallow-amine.

The component (ii)

The lubricant concentrate according to the invention contains as further essential components one or more ether carboxylic acid compounds with the general formula I, $$R^1—(O(CH_2)_m)_nOCH_2COO^-M^+ \quad (I),$$

wherein $R^1$ is a saturated, linear or branched alkyl rest with 1 to 22 carbon atoms or a mono or polyunsaturated linear or branched alkaryl or alkinyl rest with 2 to 22 carbon atoms or a possibly mono or poly $C_1$–$C_{22}$ alkyl or $C_2$–$C_{22}$ alkenyl or alkinyl substituted aryl rest, R is a positive number between 1 and 30, and M is hydrogen or an alkali metal.

As ether carboxylic acids with the general formula (I), which can be applied advantageously, can be mentioned among others:

| $R^1$ | n | CTFA - name |
|---|---|---|
| Lauryl | 2.5 | Laureth-4 carboxylic acid |
| Lauryl | 3.8 | Laureth-5 carboxylic acid |
| Lauryl | 4.5 | Laureth-6 carboxylic acid |
| Lauryl | 10 | Laureth-11 carboxylic acid |
| Lauryl | 13 | Laureth-14 carboxylic acid |
| Oleyl | 5 | Oleth-6 carboxylic acid |
| Oleyl | 9 | Oleth-10 carboxylic acid |
| Octylphenol | 8 | Octoxynol-9 carboxylic acid |
| Octylphenol | 19 | Octoxynol-20 carboxylic acid |
| Norylphenol | 0 | Nonoxynol-carboxylic acid |
| Norylphenol | 7 | Nonoxynol-8 carboxylic acid |
| Stearyl | 6 | Steareth-7 carboxylic acid |

-continued

| $R^1$ | n | CTFA - name |
|---|---|---|
| Stearyl | 10 | Steareth-11 carboxylic acid |
| Cetyl/Stearyl | 6 | Ceteareth-7 carboxylic acid |
| Lauryl | 16 | Laureth-17 carboxylic acid |
| Tallow | 6 | Talloweth-7 carboxylic acid |

Preferred compounds according to the general formula I are those whereby $R^1$ is a $C_3$–$C_{18}$- alkyl group or alkenyl group, n is between 2 and 9 and M is hydrogen, sodium or potassium. Most preferred is when $R^1$ is an oleyl group and n is 9.

The ether carboxylic acids according to the general formula I are available commercially or can be synthesized according to processes known from the literature.

For example, the compounds mentioned in the table can be obtained under the trade name AKYPO from the company CHEM-Y as special tenside.

The component (iii)

The lubricant concentrate according to the invention contains as further essential components one or more polyethylene glycols with the general formula II, $$H—(OC_2H_4)_n—OH \quad (II),$$

wherein n is a positive integer between 5 and >100,000.

The polyethylene glycols (PEG's) which could be used advantageously according to the invention therefore have molecular masses of approx. 200–5,000,000 g/mol. The PEG's concern non-unity substances from a molecular point of view, i.e. polymolecular compounds which consist of collectives of macro-molecules with different molecular masses. These compounds are mostly prepared technically by means of alkaline catalyzed polyaddition of ethylene oxide (oxiran) in systems which mostly contain a low amount of water and with ethylene glycol as the starting molecule.

In order to characterize the types frequently the main point of the molecular weight division is used in the art. Thus the literature and common designation is, for instance, PEG 200, PEG 400, PEG 1000, PEG 10,000, etc.

PEG's with molecular masses of <approx. 25,000 g/mol, i.e. n between approx. 5 and approx. 580 are preferred within the scope of the invention; these actual PEG's are liquid under normal conditions of pressure and temperature and therefore allow a very simple handling. Especially preferred are PEG's with n approximately between 8 and 13. Such compounds can be obtained for example under the trade name "Plurol" from the company BASF.

The component (iv)

The component (iv) is optional and therefore only possibly contained in the lubricant concentrate according to the invention.

The compounds which can be applied within the scope of the invention as component (iv) include among others water and/or acids. The added water may be soft water, hard water or softened water. For the acids all the suitable inorganic or organic acids can be used which, on the one hand, can adjust the pH-value to the desired value and, on the other hand, can improve the solubility of different amines in water. For example, when imidazoline derivatives according to the formulas XII, XIV, XV and/or XVI are used, it will be preferred that organic acids are used as a constituent of the component (iv), to neutralize the lubricant concentrate and to improve the solubility of the component (i). Organic acids are preferred thereby, because the formed salts with imidazolines or its derivatives when inorganic salts are used are less soluble in water than the salts of the organic acids. Thereby also the length of the carbon chain of the organic acids which preferably are used is of some importance. The water hardness tolerance of the lubricant concentrate decreases with increasing chain lengths of the acids. Organic acids with chain lengths up to 6 C-atoms are preferred thereby. When the molecular frame of the organic acids contains more than 8 carbon atoms it will be possible that the composition becomes unstable in hard water. Therefore, organic acids with longer chains for improving the solubility should be avoided in relation to imidazoline as component (i) in hard water. With the term "soft water" is meant, before and following, water with a hardness of <7° d, which corresponds to a carbonate content of <1.3 mmol/l. The higher degrees of hardness (medium hardness of water= 7–14°=1.3–2.5 mmol/l; hard water=14–21°=2.5–3.8 mmol/l; very hard water=>21°=>3.8 mmol/l are referred to within the context of the invention as "hard water".

Mostly the following aids and or additives qualify besides water and/or acids as component (iv):

solution intermediates, for example alcohols, polyalcohols, ether or polyether, especially isopropanol, butylglycol, butyldiglycol or ethyleneglycolether;

The amount of the solution intermediates to be used should be determined according to the individual amine to used, the professional will calculate the required solution intermediate in the individual case by means of trial and error. In general additions of solution intermediates in the range of 5 to 20 wt. %, calculated on basis of the total composition, will be sufficient.

Further, as aid and/or additives according to the present invention particularly non-ionic and/or amphoteric tensides merit consideration, for example fatty alcohols and alkoxylated fatty alcohols. These tensides can improve the moistening of the chain and conveyor belts insofar as this is required in an individual case. In general tenside additions in the range of 1 to 5 wt. %, calculated on basis of the total composition are sufficient for this purpose.

Further additives include anti foaming agents, foam regulators, foam stabilizers, moistening agents, coupling agents, chelation agents or chelate formers or solubility improvers, biocides, like e.g. bactericides, corrosion inhibitors, pH-buffers, as well as combinations of representatives of the previously mentioned classes of substances.

Although the favourable effects according to the invention can already be realized with arbitrary proportions of the components (i) to (iii), the lubricant concentrate according to the invention shows exceptionally favourable effects when the components (i):(ii) are present in a proportion of 1:0.5 to 1:2, always calculated on basis of the weight of all the components (i) as well as (ii).

Especially preferred is also a concentrate which is characterized that the components (i):(iii) are present in a proportion of 1:0.75 to 1:3, calculated on basis of the weight of all the components (i) as well as (iii).

As long as the proportion of amine to ether carboxylic acid to polyethylene glycol is within the mentioned range, excellent clear solubility will be obtained in an aqueous medium as well as an excellent gliding property and at the same time a considerably lower toxicity will be achieved compared to compositions without the addition of polyethylene glycol and ether carboxylic acids.

The lubricant concentrate according to the invention contains the amine component (i) as a rule in an amount between 0.5 and 6 wt. % (wt/wt), whereby the amount of 6 wt. % is already clearly less than is the case with comparable concentrates which are known from the art. The amine component (i) is present in an amount of 1.0 to 4 wt. % in a preferred version of the lubricant concentrate according to the invention, whereby amounts of 2 to 2.5 wt. % (wt/wt) are especially preferred. With contents of more than 4 wt. % already disadvantages develop with respect to the water hardness tolerance, while values of >6 wt. % cannot be tolerated according to the invention. If the content of the amine component (i) is reduced to a value below 1 wt. %, calculated on basis of the total amount of the lubricant concentrate, then the gliding effect of the lubricant concentrate will deteriorate increasingly. If the content of amine component (i) gets below 0.5 wt. % then the friction value increases to such an extent that the lubricant concentrate does not lubricate sufficiently anymore.

The ether carboxylic acid (component ii) is contained in the lubricant concentrate according to the invention generally in an amount of 1 to 6 wt. %. A value of 1.5 to 4 wt. % is preferred; it has been shown that a value of 2 to 2.5 wt. % of ether carboxylic acids in the lubricant concentrate according to the invention is very favourably. The indicated amounts thereby relate to weight % (wt/wt).

The foam behaviour of the lubricant concentrate gets unfavourable if the amount of the ether carboxylic acids decreases to below 1 wt. %. Furthermore, the turbidity increases. If the amount of ether carboxylic acids increases to above 6% then additional positive effects cannot be recognized anymore.

The component (iii) generally is present in the lubricant concentrate according to the invention in an amount between 1.0 and 9 wt. % Amounts of 1.5 to 6 wt. % are preferred, particularly preferred are values of 3 to 4 wt. % (wt/wt). If the content of polyethylene glycol in the lubricant concentrate is below 1.5 wt. % then the concentrate will not possess the available water hardness tolerance according to the invention anymore. Furthermore, the turbidity of the concentrate will increase. The friction value of the lubricant concentrate according to the invention increases to an unacceptable value if the concentration is more than 9 wt. %.

In a preferred implementation the concentrate according to the invention is characterized by up to 6 wt. % (i), 1 to 6 wt. % (ii), 1.5 to 9 wt. % (iii) and 79 to 96.5 wt. % (iv), whereby all weight percentages are chosen such that a 100% (wt/wt) concentrate will be obtained.

In a particularly efficient version the concentrate according to the invention shows the following contents:

(i) 2 to 2.5 wt. %, (ii) 2 to 2.5 wt. %, (iii) 3 to 4 wt. % and (iv) 91 to 93 wt. %, whereby the amounts (i)–(iv) are chosen such that the total results in 100 wt. %.

Furthermore, the invention relates to a process for the preparation of the lubricant according to the invention.

This is produced by mixing of the components (i), (ii) and (iii), possibly with addition of the component (iv). Water is preferred as component (iv) thereby. Therefore, subject of the invention is a process for the preparation of a lubricant concentrate by means of mixing of the components (i) to (iii) and dilution of the mixture obtained in this way with water, as a component (iv) and possibly addition of further components (iv).

The present invention further relates to the use of lubricant concentrates according to the art described before as chain lubricant in the food industry, particularly for the lubricating, cleaning and disinfecting of feed and conveyance installation in the food industry, particularly automatic chain and belt lubrication installations. The present invention particularly relates to the use of the lubricant concentrates described before in the form of a 0.01 to 50 wt. %, preferably 0.1 to 0.5 wt. %, aqueous solution as chain lubricant for automatic chain and belt lubricating installations.

Moreover, the invention relates to an aqueous use solution for lubricating, cleaning and disinfecting of feed and conveyance installations in the food industry, which is characterized by a content of the following components in combinations:

(i) one or more amines;

(ii) one or more ether carboxylic acid compounds with the general formula I $$R^1—(O(CH_2)_m)_nOCH_2COO^-M^+ \quad (I),$$

wherein $R^1$ is a saturated, linear or branched $C_1$–$C_{22}$ alkyl rest, a mono or polyunsaturated, linear or branched, alkenyl or alkinyl rest with 2 to 22 carbon atoms or possibly a mono or poly $C_1$–$C_{22}$ alkyl or $C_2$–$C_{22}$ alkenyl or alkinyl substituted aryl rest, m is 2 or 3, n is a positive number in the range of 1 to 30, and M is hydrogen or an alkali metal;

(iii) is one or more polyethyleneglycol (PEG) with the general formula II $$H—(OC_2H_4)_n—OH \quad (II),$$

wherein n is a positive number between 5 and ≦100,000;

whereby the portion of the compounds (i)+(ii)+(iii) with respect to the concentrate is 1 to 100 wt. %, and this possibly (iv) contains up to 99 wt. % (wt/wt) of the usual aids and additives.

According to the invention this lubricant solution (aqueous use solution) can be obtained from the lubricant concentrate according to the invention by means of dilution with water and a dilution factor of 2 to 10,000, preferably with a factor 300 to 500. It is particularly preferred thereby to dilute the concentrate with water to 0.02 to 80% (volume/volume).

Particularly preferred are lubricant solutions which show a content of 0.002 to 0.1 wt. %, in particular 0.003 to 0.05 wt. % of an amine derivative (component i) and a pH-value of between 5 and 8.

Finally, the present invention relates to the use of the aqueous use solution described before as a chain gliding and lubricating means suitable for lubricating, cleaning and disinfecting of feed and conveyance installations, in particular by means of immersion and/or automatic belt lubricating installations, in the food industry. The products according to the invention do not cause stress rupture corrosion, in contrast to standard soap products, when applied with plastic objects, and therefore can be applied in particular without problems for PET or PC-objects. Accordingly, the lubricant solutions according to the invention can find use as chain lubricant for the feed or conveyance of objects or bottles made of glass, glass covered with a plastic layer, plastics, in particular polyethyleneterephthalate, polycarbonate or polyvinylchloride, tin plate or aluminium, respectively varnished or plastic-layered containers made of these metals.

Therefore, the invention also relates to a process for the conveyance of beverage packings made of metal, glass, paper, cardboard and/or plastic, whereby a beverage conveyance device is contacted with a lubricating, cleaning and disinfecting amount of an aqueous use solution, as is defined herein.

The products according to the invention show, compared to known lubricants, a considerably better clear solubility in an aqueous medium as well as considerably better gliding properties, whereby they exhibit at the same time a considerably lower toxicity as compositions without addition of polyethylene glycol and ether carboxylic acids. Therewith, the desired technical properties of the lubricant concentrate, respectively the aqueous lubricant solution, can be adjusted purposefully by the choice of the amine, respectively the anion.

The following examples and comparative examples serve to present a more detailed explanation of the invention:

The friction resistance, the foam behaviour and the clear solubility in water of the combinations to be applied according to the invention are presented by the examples according to the invention B 1a to B 1c and B 5 to B 7. The examples B 5 and B 6 show the good micro-biocide action of the compositions to be applied according to the invention. The comparative examples V 2a to V 4, which mixtures relate to the state of the art, serve as comparison.

I Methods a.) Friction coefficient

The experiments for the measurement of the friction coefficient, hereafter indicated in short as "friction value", were performed on a University bottle conveyor under the following conditions:

Measurement of the friction value of 12 0.5 liter NRW beer bottles, filled with water, as tension force, with a dynamometer (force reader box).

Speed of the bottle conveyor: approx. 1 m/sec. Spraying of the bottle conveyor with a 0.3% belt lubricating solution.

Phase time: 20 sec. spraying/20 sec. interval Spraying performance per spray nozzle: 4 liter/h The friction value "m" mentioned hereafter is defined as the quotient of the measured tension force for a bottle in relation to the weight of the bottle in grams.

Furthermore, the products were tested with hard water (16° dH) according to the provisions of DIN 53 902 and tested in completely desalinated water.

b.) Clear solubility

The compositions to be applied according to the invention show an excellent clear water solubility, which can be shown by the performed turbidity measurements (nephelometer). Herewith, the regular removal of waste, which develops because of the reaction of "large anions", like sulphate, phosphate and carbonate, with the belt lubricating solution, can be prevented. For this purpose 0.3% use solutions were measured over a period of 48 hours (standing time over a weekend). These experiments were performed in the Berlin water works (water analysis in the installation). The clear solubility is expressed in FNU (formazine nephelometric units).

0 to 1 FNU=clear 1 to 10 FNU=weak opalescent 10 to 50 FNU=turbidity 50 to >100 FNU=strongly turbidity c. Foam behaviour The foam behaviour was calculated according to the following method:

100 ml of the use solution (0.3%) was transferred into a 250 ml measuring cylinder. Thereafter it was shaken 30 times during 30 seconds and after a further 20 seconds the volume of the foam above the 100 ml mark was read off.

d. Disinfection action

The compositions to be applied according to the invention show a remarkably good micro-biocide action, as can be shown by way of the performed quantitative suspension tests with aid of the DVG (Deutsche Veterinärmedizinische Gesellschaft=German Veterinary Medical Association).

Method: Quantitative suspension test without load; according to the directives of the DVG.

Testing temperature: 20° C.

Use concentration: 0.3%

Reaction time: 10 min.

Test germs:

Staph. aureus; DSM 799; KBE/ml=$3.0\times10^7$

Pseud. aeruginosa; DSM 939; KBE/ml=$5.7\times10^8$

Sacch. cerevisiae; DSM 1333; KBE/ml=$1.5\times10^7$ e.) Material compatibility tests—beverage boxes In these tests the compatibility of the belt lubricating solutions with the usual colours for printing the beverage boxes was examined. For this purpose, belt lubricating solutions were placed at the disposal in which beverage boxes (manufacturer Coca Cola Company) were immersed to about one third over a 24 hours period. Thereafter, the boxes were rinsed with fresh water and allowed to dry. The colour releases were estimated visually. As reference a box was immersed for 24 hours in clean water and treated in the same way as the test boxes.

f.) Material compatibility PET

The material compatibility of the mixture according to the invention as well as a comparative example was examined in a test.

For this, the following equipment was needed:

Climatic test cabinet, in each case 20 new PET bottles (1.5 L) in crates, $CO_2$-cylinder with fitting reducing valve, attachment for filling of the bottles with $CO_2$, separate manometer for testing the bottles with regard to $CO_2$;

The tests were executed in the following manner

At first, the bottles were filled with 1.5 L VE-water, thereafter 3.0–3.1 bar $CO_2$ was led into the bottles via an attachment. Then the quantity of $CO_2$ was dissolved into the water by means of shaking. All $CO_2$ was considered to be dissolved only after the test manometer indicated 0 bar.

1.) The bottles were now dipped shortly into concentrated belt lubricant (BSM) (~2 cm) and thereafter allowed to stand for 24 hours.

2.) Thereafter the bottles were filled in crates and allowed to stand in a climatic cabinet at 38° C. and 85% relative humidity for 6 days.

As reference a bottle was taken along in each crate which was not dipped into BDM.

At the end of the test a visual estimation was made. Here, 5 categories are distinguished.

O: No damages

A: Minor damages

B: Moderate, superficial cracks

C: Multiple, moderately deep cracks

D: Multiple, deep cracks

II. The summary of the applied lubricants in the examples (B) and in the comparative examples (V) are presented in Table 1.

TABLE 1

| Example | N-octyldecenyl-propylene diamine (i) | alkyl (poly-1-oxa-propylene)-oxa-ethane carboxylic acid (ii) | polyethylene-glycol (200) (iii) |
|---|---|---|---|
| B1 a) | 2 | 2 | 3 |
| B1 b) | 4 | 2 | 3 |
| B1 c) | 6 | 2 | 3 |
| V2 a) | 2 | 2 | 0 |
| V2 b) | 4 | 2 | 0 |
| V2 c) | 6 | 2 | 0 |
| V3 a) | 2 | 0 | 3 |
| V3 b) | 4 | 0 | 3 |
| V3 c) | 6 | 0 | 3 |
| V4 | 8 | 0 | 0 |
| B5 | 6 | 1 | 1 |
| B6 | 4 | 2 | 2 |
| B7 | 2 | 3 | 3 |
| B8 | 1 | 1.5 | 1.5 |

The listings of the ingredients are in weight per cent, whereby the compositions with acetic acid were adjusted to a pH-value of 6.0 and were filled up with VE-water to 100%.

Table 2 shows an overview of the performed examinations on the individual examples and comparative examples a)–f).

TABLE 2

| Example | Friction coefficient a) | Clear solubility b) | Foam behaviour c) | Quantitative suspension test d) | Material compatibility boxes e) | Material compatibility PET f) |
|---|---|---|---|---|---|---|
| B1 a) | + | + | + | − | − | − |
| B1 b) | + | + | + | − | + | + |
| B1 c) | + | + | + | − | − | − |
| V2 a) | + | + | + | − | − | − |
| V2 b) | + | + | + | − | − | − |
| V2 c) | + | + | + | − | − | − |
| V3 a) | + | + | + | − | − | − |
| V3 b) | + | + | + | + | − | − |
| V3 c) | + | + | + | + | − | − |
| V4 | + | + | + | + | + | + |
| B5 | + | + | + | + | − | − |
| B6 | + | + | + | + | − | − |
| B7 | + | + | + | − | − | − |

III Results with respect to a) friction coefficient and c) foam behaviour of 0.3% use solutions are presented in table 3.

TABLE 3

| Denomination | Friction coefficients, Foam behaviour: Friction coefficient [m] hard water | Friction coefficient [m] soft water | Foam behaviour [ml foam volume] |
|---|---|---|---|
| B1 a) | 0.103 | 0.101 | 20 |
| B1 b) | 0.110 | 0.116 | 38 |
| B1 c) | 0.104 | 0.106 | 50 |
| V2 a) | 0.143 | 0.145 | 47 |
| V2 b) | 0.142 | 0.149 | 47 |

TABLE 3-continued

| Denomination | Friction coefficients, Foam behaviour: Friction coefficient [m] hard water | Friction coefficient [m] soft water | Foam behaviour [ml foam volume] |
|---|---|---|---|
| V2 c) | 0.147 | 0.143 | 49 |
| V3 a) | 0.153 | 0.142 | 60 |
| V3 b) | 0.150 | 0.146 | 60 |
| V3 c) | 0.157 | 0.143 | 63 |
| V4 | 0.140 | 0.133 | 58 |
| B5 | 0.124 | 0.119 | 30 |
| B6 | 0.112 | 0.102 | 25 |
| B7 | 0.101 | 0.095 | 25 |
| B8 | 0.118 | 0.110 | 18 |

with respect to b) clear solubility

The results of 0.3% use solutions are presented in the following table 4.

TABLE 4

| Denomination | Friction coefficients, Foam behaviour: 0.25 h | 24 h | 48 h |
|---|---|---|---|
| B1 a) | 0.23 | 0.66 | 0.81 |
| B1 b) | 0.61 | 4.33 | 6.18 |
| B1 c) | 1.13 | 6.05 | 8.21 |
| V2 a) | 0.42 | 0.83 | 1.01 |
| V2 b) | 0.89 | 6.87 | 13.52 |
| V2 c) | 1.25 | 51.7 | 94.1 |
| V3 a) | 98.3 | 33.2 | 21.4 |
| V3 b) | 324 | 98.1 | 64.2 |
| V3 c) | 376 | 108 | 137.7 |
| V4 | 375 | 124.1 | 59.6 |
| B5 | 0.99 | 4.45 | 6.23 |
| B6 | 0.7 | 3.14 | 4.42 |
| B7 | 0.32 | 0.51 | 0.6 |
| B8 | 0.21 | 0.43 | 0.52 |

Water analysis conductivity mS/cm: 1030
pH value 6.5
m value mVal/l: 0.44
Hardness ° dH 28.6
Chloride mg/l: 94.0
Nitrate mg/l: 4.0
Sulphate mg/l: 398.0
Total inorg. $P_2O_5$ mg/l: 2.4 with respect to d) microbiological tests (quantitative suspension tests)

Table 5 shows the results.

TABLE 5

| Test mixtures | Log. reduction factor *staph. aureus* | Log. reduction factor *pseud. aeruginosa* | Log. reduction factor *sacch. cerevisiae* |
|---|---|---|---|
| V3 b) | >6.18 | 2.79 | >4.89 |
| V3 c) | 4.48 | 2.94 | >4.89 |
| V4 | >6.18 | 2.95 | >4.89 |
| B5 | >6.18 | 2.93 | >4.89 |
| B6 | 4.48 | 2.21 | >4.89 |

with respect to e) examination of colour release with Coca-cola boxes:

As can be seen on the accompanying pictures, B 1b) does not result in colour release; in contrast to V4, where this is clearly visible.

with respect to f.) material compatibility to PET

The results of B1) is shown in table 6.

TABLE 6

| Belt lubricant B1 b) | | | | | | | | | | | | |
|---|---|---|---|---|---|---|---|---|---|---|---|---|
| | Stand-surface | | | | | Radial-base | | | | | Leakage | |
| No. | 0 | A | B | C | D | 0 | A | B | C | D | yes | no |
| 1 | | X | | | | | X | | | | | X |
| 2 | | X | | | | | X | | | | | X |
| 3 | | X | | | | | X | | | | | X |
| 4 | | X | | | | | X | | | | | X |
| 5 | | X | | | | | X | | | | | X |
| 6 | | X | | | | | X | | | | | X |
| 7 | | X | | | | | X | | | | | X |
| 8 | | X | | | | | X | | | | | X |
| 9 | | X | | | | | X | | | | | X |
| 10 | | X | | | | | X | | | | | X |
| SUM | | 10 | | | | | 10 | | | | | 10 |

The results of the comparative example V4 is shown in table 7.

TABLE 7

| Belt lubricant V4 | | | | | | | | | | | | |
|---|---|---|---|---|---|---|---|---|---|---|---|---|
| | Stand-surface | | | | | Radial-base | | | | | Leakage | |
| No. | 0 | A | B | C | D | 0 | A | B | C | D | yes | no |
| 1 | | | X | | | | | X | | | | X |
| 2 | | | X | | | | | | X | | | X |
| 3 | | | | X | | | | | X | | | X |
| 4 | | | | X | | | | | X | | | X |
| 5 | | | | X | | | | | X | | | X |
| 6 | | | | X | | | | X | | | | X |
| 7 | | | X | | | | | X | | | | X |
| 8 | | | X | | | | | X | | | | X |
| 9 | | | | X | | | | | X | | | X |
| 10 | | | X | | | | | X | | | | X |
| SUM | | | 5 | 5 | | | | 5 | 5 | | | 10 |

IV. Summary

The values show that the compositions according to the invention combine the advantages of soap-free lubricants, independence on water quality, cleaning and disinfection with those of the lubricants on basis of soap, biological degradability. The disadvantages, as the annoyingly strong foaming, the lacking gliding effect in soft water, particularly the regular removal of precipitations, can be avoided by using the compositions according to the invention.

Moreover, the compositions to be applied according to the invention do not cause stress rupture corrosion and therefore can be employed without problems for PET and PC objects (PET=polyethyleneterephthalate, PC=polycarbonate), furthermore the compositions to be applied according to the invention do not cause any colour release with printed beverage boxes in contrast to standard amine products.

We claim:

1. Lubricant concentrate, of which the aqueous use solution is suited for lubricating, cleaning and disinfecting of feed and conveyance installations in the food industry, comprising:

(i) from 0.5 to 6 wt. % of at least one amine;

(ii) from 1 to 6 wt. % of an ether carboxylic acid compound with the general formula I $$R^1—(O(CH_2)_m)_nOCH_2COO^{-M+} \quad (I)$$

wherein $R^1$ is selected from the group consisting of a saturated, linear or branched $C_1$–$C_{22}$ alkyl rest, a mono or polyunsaturated, linear or branched, alkenyl or alkinyl rest with 2 to 22 carbon atoms and a mono or poly $C_1$–$C_{22}$ alkyl or $C_2$–$C_{22}$ alkenyl or alkinyl substituted aryl rest, m is 2 or 3, n is a positive number in the range of 1 to 30, and M is hydrogen or an alkali metal;

(iii) from 1.5 to 9 wt. % of a polyethyleneglycol with the general formula II $$H—(OC_2H_4)_n—OH \quad (II),$$

wherein n is a positive number between 5 and less than 100,000;

(iv) from 79 to 96.5 wt. % of water.

2. Concentrate according to claim 1, with the characteristic that it contains the components (i): (ii) in a proportion of 1:0.5 to 1:2, always calculated on basis of the weight of all components (i) as well as (ii).

3. Concentrate according to claim 1, with the characteristic that it contains the components (i): (iii) in a proportion of 1:0.75 to 1:3, always calculated on basis of the weight of all components (i) as well as (iii).

4. Concentrate according to claim 1, characterized by the following composition comprising:

(i) 2–2.5 wt. %, (ii) 2–2.5 wt. %, (iii) 3–4 wt. % and (iv) 91–93 wt. %.

5. An aqueous lubricant solution comprising a lubricant concentrate diluted with water by a factor of 2 to 10,000 on a volume basis, the concentrate comprising:

(i) from 0.5 to 6 wt. % of at least one amine;

(ii) from 1 to 6 wt. % of an ether carboxylic acid compound with the general formula I $$R^1—(O(CH_2)_m)_nOCH_2COO^-M^+ \quad (I),$$

wherein $R^1$ is selected from the group consisting of a saturated, linear or branched $C_1$–$C_{22}$ alkyl rest, a mono or polyunsaturated, linear or branched, alkenyl or alkinyl rest with 2 to 22 carbon atoms and a mono or poly $C_1$–$C_{22}$ alkyl or $C_2$–$C_{22}$ alkenyl or alkinyl substituted aryl rest, m is 2 or 3, n is a positive number in the range of 1 to 30, and M is hydrogen or an alkali metal;

(iii) from 1.5 to 9 wt. % of a polyethyleneglycol with the general formula II $$H—(OC_2H_4)_n—OH \quad (II),$$

wherein n is a positive number between 5 and less than 100,000;

(iv) from 79 to 96.5 wt. % of water.

6. The lubricant solution according to claim 5 wherein the dilution factor is from 300 to 500.

7. A process for the conveyance of beverage packagings selected from the group consisting of metal, glass, paper, cardboard and plastic, comprising contacting a beverage conveyance installation with a lubricating amount of an aqueous lubricant solution, the solution being formed by dilution of a lubricant concentrate with water by a factor of 2 to 10,000 on a volume basis, the concentrate comprising:

(i) from 0.5 to 6 wt. % of at least one amine;

(ii) from 1 to 6 wt. % of an ether carboxylic acid compound with the general formula I $$R^1—(O(CH_2)_m)_nOCH_2COO^{-M+} \quad (I),$$

wherein $R^1$ is selected from the group consisting of a saturated, linear or branched $C_1$–$C_{22}$ alkyl rest, a mono or polyunsaturated, linear or branched, alkenyl or alkinyl rest with 2 to 22 carbon atoms and a mono or poly $C_1$–$C_{22}$ alkyl or $C_2$–$C_{22}$ alkenyl or alkinyl substituted aryl rest, m is 2 or 3, n is a positive number in the range of 1 to 30, and M is hydrogen or an alkali metal;

(iii) from 1.5 to 9 wt. % of a polyethyleneglycol with the general formula II $$H—(OC_2H_4)_n—OH \quad (II),$$

wherein n is a positive number between 5 and less than 1 00,000;

(iv) from 79 to 96.5 wt. % of water.

8. Aqueous use solution for lubricating, cleaning and disinfecting of feed and conveyance installations in the food industry, obtainable by dilution of the concentrate according to the claim 1 with water to 0.02:80% (volume/volume).

* * * * *